US006027585A

United States Patent [19]

Patterson et al.

[11] Patent Number: 6,027,585

[45] Date of Patent: Feb. 22, 2000

[54] TITANIUM-TANTALUM ALLOYS

[75] Inventors: R. Alan Patterson; Paul S. Dunn, both of Los Alamos; John F. Bingert, Jemez; James D. Cotton, Santa Fe, all of N.Mex.

[73] Assignee: The Regents of the University of California office of Technology Transfer, Alameda, Calif.

[21] Appl. No.: 08/404,214

[22] Filed: Mar. 14, 1995

[51] Int. Cl.[7] ..... C22C 1/02

[52] U.S. Cl. ..... 148/538; 148/557; 148/668; 148/669; 148/670; 420/417; 420/427

[58] Field of Search ..... 420/417, 427; 148/538, 557, 668, 669, 670, 671

[56] References Cited

U.S. PATENT DOCUMENTS 2,964,399 12/1960 Lyons ..... 420/417
3,161,503 12/1964 Lenning et al. ..... 420/417
3,384,480 5/1968 Snyderman ..... 420/417
3,565,602 2/1971 Konisi et al. ..... 420/417

*Primary Examiner*—John Sheehan
*Attorney, Agent, or Firm*—Bruce H. Cottrell

[57] ABSTRACT

A process of preparing a titanium-tantalum alloy including forming a suitable mixture of essentially pure titanium powder and essentially pure tantalum powder, melting the mixture of titanium powder and tantalum powder by plasma torch melting under a pressure greater than atmospheric pressure to form a titanium-tantalum solution, and casting the molten solution of titanium-tantalum to form a solid homogeneous titanium-tantalum product is disclosed.

The process can further include hot-rolling the cast solid homogeneous titanium-tantalum product to form a sheet of the titanium-tantalum product.

7 Claims, 2 Drawing Sheets

TITANIUM-TANTALUM ALLOYS

FIELD OF THE INVENTION

The present invention relates to alloys of titanium and tantalum and to a process for preparation of such alloys. This invention is the result of a contract with the Department of Energy (Contract No. W-7405-ENG-36).

BACKGROUND OF THE INVENTION

Phase diagrams of titanium-tantalum blends have been examined for over forty years, see Summers-Smith, J. Inst. Metals, vol. 81, pp. 73–76 (1952). Titanium-tantalum alloys have also been suggested by Breme et al., The International Journal of Oral & Maxillofacial Implants, vol. 4, no. 2, pp. 113–118 (1989), and by Steinemann et al. in U.S. Pat. No. 4,040,129, for use as biocompatible materials. Yet, there has not been any known detailed investigation into the development of titanium-tantalum alloys.

An extensive investigation of titanium-tantalum alloys was undertaken by the inventors with especial interest into the effects of processing conditions on, e.g., the strength and oxidation resistance properties of such alloys. In the course of the investigation, a ductile, homogeneous titanium-tantalum product and processes of preparing the same were identified. Further, the product was unique in that sufficient titanium-tantalum alloy was produced for the manufacture of practical articles. This capability has been demonstrated by the fabrication of 3 to 6 inch diameter hemispherical cups through subsequent processing of the as-cast ingot. The combination of large size scale articles and good chemical homogenity (which directly pertains to mechanical properties) has not heretofore been achieved in this alloy system.

It is an object of the present invention to provide a process of preparing ductile, homogeneous titanium-tantalum alloys and the product of such a process.

SUMMARY OF THE INVENTION

To achieve the foregoing and other objects, and in accordance with the purposes of the present invention, as embodied and broadly described herein, the present invention provides a process of preparing titanium-tantalum alloys including forming a suitable mixture of essentially pure titanium powder and essentially pure tantalum powder, melting the mixture of titanium powder and tantalum powder by plasma torch melting under a pressure greater than atmospheric pressure to form a titanium-tantalum solution, and casting the molten solution of titanium and tantalum to form a solid homogeneous titanium-tantalum product.

In another embodiment the cast solid homogeneous titanium-tantalum product is subsequently subjected to hot-rolling to form a sheet of the titanium-tantalum product. This sheet served as starting material for the fabrication of formed shapes.

The present invention further provides homogeneous titanium-tantalum alloys produced by the above process, the resultant alloys characterized by properties which vary with composition and selected processing conditions.

DETAILED DESCRIPTION

Figure 1:
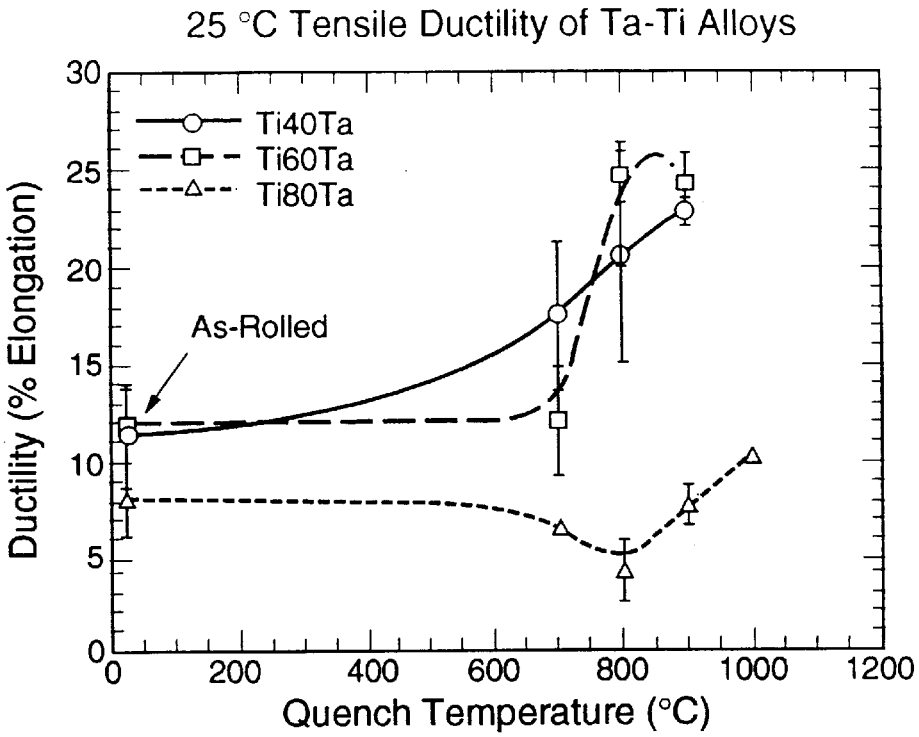
FIG. 1 is a graph illustrating the room temperature tensile elongation of titanium-tantalum alloys following various quenching from temperatures in accordance with the present invention.

The present invention is concerned with titanium-tantalum alloys and their preparation. Such alloys should be homogeneous in composition and preferably ductile. By "homogeneous" is meant that the alloy includes no domains of either titanium or tantalum larger than about 1 millimeter (mm). By "ductile" is meant that the material has a tensile elongation of at least about ten percent. The present invention is further concerned with titanium-tantalum alloys prepared in the present process that possess improved mechanical properties such as tensile elongation, tensile yield strength and ultimate tensile strength.

Initially, the titanium and tantalum materials used in forming the alloy must be mixed. The large differences in density and melting points between titanium (1675° C.) and tantalum (2996° C.) requires careful melting procedures in order to obtain a homogeneous product. Without such careful control, microstructural heterogeneities such as large inclusions of unmelted tantalum can occur and degrade the resultant properties of the titanium-tantalum alloy. The microstructures of the titanium-tantalum alloys prepared by the present process are homogeneous with respect to phase distribution and composition.

In one embodiment, the starting materials for the titanium-tantalum alloy consists of titanium powder and tantalum powder. By the term "powder" it is generally meant discrete particles of titanium or tantalum from about 1 micron to about 1 mm. Larger particle sizes may be possible by use of extra remelting stages, remelting discussed below. Preferably, both materials should be at least 99.5% pure. The amounts of titanium and tantalum powders necessary to achieve the desired alloy percentage compositions are weighed and then thoroughly mixed such that segregation of the materials is minimized. Particular care such as sound powder mixing practice, e.g., use of a rotating mill, must be taken so that the tantalum, with a density nearly four times that of titanium, does not segregate to the bottom of the mixture.

The mixed powders are then loaded into a die, e.g., a three inch diameter cylindrical steel die, and uniaxially pressed to, e.g., 100 tons at room temperature, until the pressed material has a density sufficient to withstand handling stresses. The resulting pressed slug from the mixed powder and granules can then be removed from the die for subsequent processing by melting. Generally, a sufficient number of such pressed slugs should be prepared, on a weight basis, to attain the total amount of material necessary for the desired final titanium-tantalum product weight.

The pressed slugs can then be loaded into the feeder of a plasma torch melter and subsequently introduced into the molten metal pool under the torch at a rate of 4 to 6 slugs at a time. Melting of the slugs in a plasma torch melter is considered critical to the present process. The plasma torch melter allows melting to be conducted at pressures exceeding atmospheric pressure and this is considered essential because of the large difference in melting temperatures of the titanium and tantalum. Under a typical vacuum, titanium begins to boil before tantalum melts. An argon overpressure of about 0.05 atmospheres is used to avoid any significant vapor losses of the titanium until the tantalum is completely melted. The molten pool feeds into a water-cooled collar six inches in diameter. Each series of slugs is melted for about three minutes before the next series of slugs is introduced. The resulting ingot from all of the slugs is then removed from the water-cooled collar and fed horizontally into the torch once again. As this melting proceeds, the molten solution of titanium and tantalum drops into another water-cooled cavity until the entire ingot is consumed. This comprises the second melting step. This re-melting step is generally repeated twice more and results in a cylindrical ingot about six inches in diameter of the cast homogeneous titanium-tantalum product. Each desired composition, e.g., 40 weight percent tantalum, 60 weight percent tantalum, or 80 weight percent tantalum, with the remainder titanium can be similarly cast. Multiple melting serves two primary purposes: first, to achieve good chemical homogeneity; and, second, to purify the material by volatilizing certain impurities such as carbon.

Agitation during the plasma torch melting is considered important in achieving a homogeneous product. Such agitation or stirring can be supplied from four separate sources including: (1) arc pressure (from a rotating arc-water-cooled copper electrode); (2) an external electromagnetic field; (3) thermal convection currents within the molten pool; and, (4) mechanical vertical oscillation of the solidified metal and molten pool of about 0.25 mm at 5 Hertz (Hz).

The cooling rate in the process of forming the titanium-tantalum product is high so as to minimize microsegregation due to coring. Coring is the development of compositional segregation during a slow cooling of a cast material. Since the cavity is water-cooled in which the titanium-tantalum alloy or product is solidified after melting by the plasma torch melter, the resulting product is highly homogeneous. Another benefit of the plasma torch melter is that the product of such a melter cools faster than an alloy product melted in an electron beam or a vacuum induction remelt (VAR), the usual methods for melting of refractory alloys. Vertical oscillation of the pool also contributes to the increased cooling rate.

A useable alloy sheet product of the cast homogeneous titanium-tantalum product can subsequently be produced. Generally, the as-cast ingot material must be thermo-mechanically processed. This can be done by cutting slices of a circular cross section from the as-cast titanium-tantalum ingot, such circular cross sections termed "slabs" and generally being about 0.5 inch to about 1.0 inch thick by about six inches in diameter. To produce a consistent rolling surface, the flat faces of the slabs are machined smooth and parallel.

The machined slabs are then heated under inert gas, e.g., argon or helium, for from about 1 hour to about 1.5 hour at from about 900° C. to about 930° C. for compositions of about 60 weight percent titanium-40 weight percent tantalum and about 40 weight percent titanium-60 weight percent tantalum, or at from about 1100° C. to about 1130° C. for compositions of about 20 weight percent titanium-80 weight percent tantalum. The heated slabs are then removed from the furnace and immediately subjected to rolling deformation in air until the slab thickness is reduced by approximately 25 percent. After such slab thickness reduction, the slabs are placed back in the furnace to be reheated to the respective temperature, e.g., to about 900° C. to about 930° C. or to about 1100° C. to about 1130° C. The reheating process generally requires from about 5 minutes to about 15 minutes. The rolling steps can be repeated as many times as needed to attain the desired thickness of the final alloy sheet product. The slab is generally rotated 90 degrees each rolling pass (termed "cross-rolling") to produce a wider product and randomize the resulting in-plane crystallographic texture of the microstructure (this may affect the mechanical properties). When the final thickness is achieved, the titanium-tantalum sheet can generally be allowed to cool in air to room temperature. The resultant titanium-tantalum alloy sheet is in what is referred to as the "as-rolled" condition.

Figure 2:
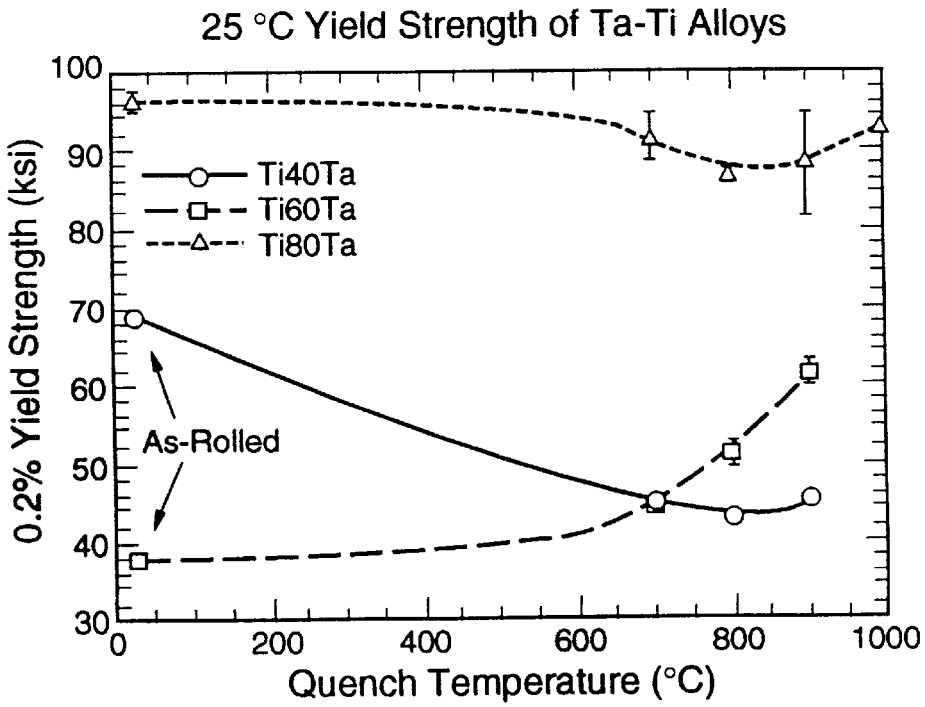
FIG. 2 is a graph illustrating the room temperature tensile yield strength in kilopounds per square inch (KSI) of titanium-tantalum alloys following various quenching from temperatures in accordance with the present invention.
Figure 3:
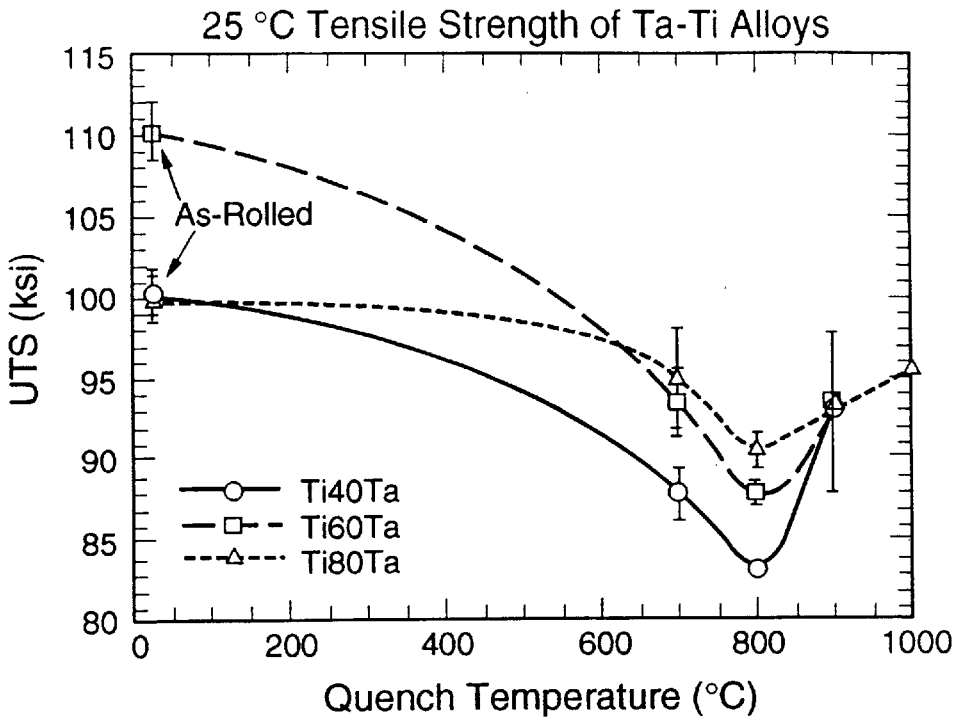
FIG. 3 is a graph illustrating the room temperature ultimate tensile strength of titanium-tantalum alloys following various quenching from temperatures in accordance with the present invention.
Figure 4:
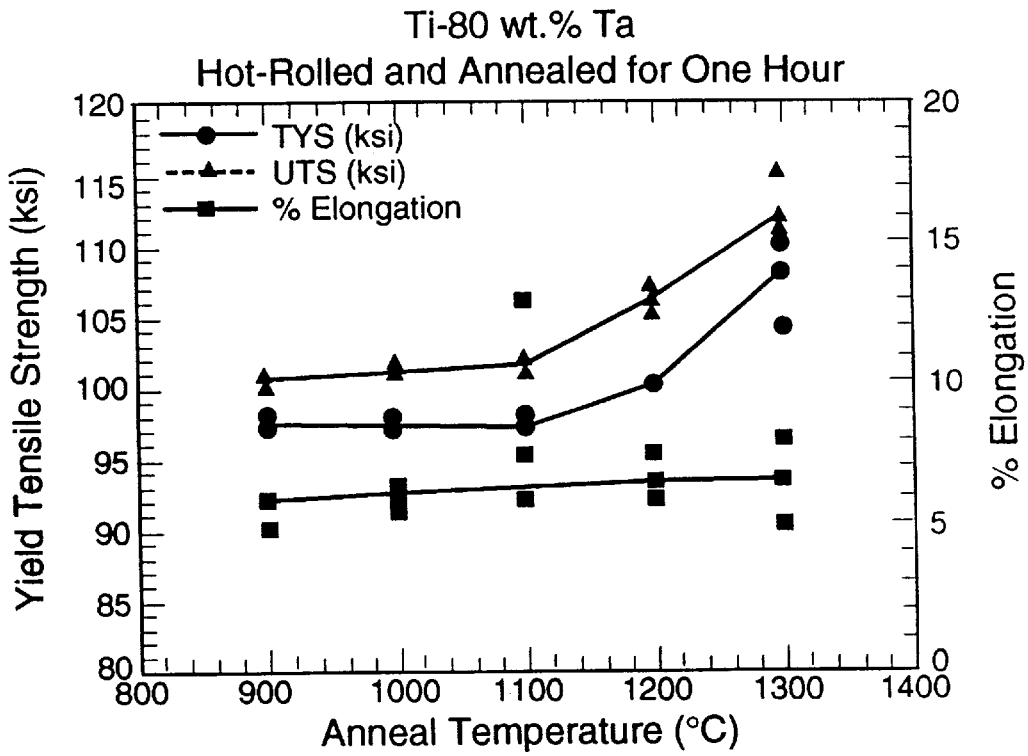
FIG. 4 is a graph illustrating the mechanical properties in tension of titanium-tantalum alloys following various annealing treatments in accordance with the present invention.

The microstructure and mechanical properties of the titanium-tantalum may be controlled by applying special heat treatments to the as-rolled sheet. Such heat treatments can consist of heating the sheet to a particular preselected temperature and cooling rapidly to room temperature, usually by quenching, while hot, into a container of water. The room-temperature mechanical properties in tension can be varied as shown in FIGS. 1, 2 and 3 by quenching from the indicated temperature after one hour at temperature. The room-temperature mechanical properties in tension of the 20 weight percent titanium-80 weight percent tantalum can also vary as shown in FIG. 4 when annealed at the indicated temperature for one hour. To attain acceptable engineering properties in the final formed article, homogeneity must be established during casting, since further mixing in the solid state (homogenization) is prohibitively slow. For instance, the presence of unmelted inclusions of tantalum is expected to lead to premature failure at the location of the inclusion under sufficient stress yielding both lower strength and ductility of the material. It would also create a site of enhanced oxidation during high temperature exposure to oxidizing environments, such as air. Thus, good homogeneity is imperative.

The present invention is more particularly described in the following examples which are intended as illustrative only, since numerous modifications and variations will be apparent to those skilled in the art.

EXAMPLE 1

A composition of 40 weight percent tantalum and 60 weight percent titanium was prepared as follows. The ductility of this alloy is maximized when heated at about 800° C. for one hour in argon gas and water-quenched. The resulting microstructure contains a mixture of $\beta$ phase and $\alpha''$ martensite. Typical properties at room temperature are 21% tensile elongation and a yield strength of 42,000 lbs/sq. in. (29.5 kg/mm$^2$). These properties are ideal for forming operations. Hemispherical cups of 3 to 6 inch diameter have been formed from this material and process.

EXAMPLE 2

A composition of 80 weight percent tantalum and 20 weight percent titanium was prepared in the as-rolled condition, as described above. Better high temperature strength was attained at this composition than in the lower percent by weight tantalum alloys of example 1. The resistance to attack by certain molten metals was also improved. Furthermore, the alloys are more thermally stable, i.e, the properties do not change as much with thermal exposure, and are especially suited for furnace hardware or applications which require good resistance to chemical attack, good high temperature stability and better oxidation resistance than pure tantalum.

EXAMPLE 3

A composition of 60 weight percent tantalum and 40 weight percent titanium was prepared as follows. This alloy is intermediate to the other two in terms of oxidation resistance and thermal stability. However, it displays obvious evidence of "shape-memory" ability and thus may lend itself to high-temperature actuator type applications. This accounts for its relatively low yield strength in the as rolled condition.

EXAMPLE 4

Compositions of 40 weight percent tantalum and 60 weight percent titanium and of 60 weight percent tantalum and 40 weight percent titanium were prepared as follows. Both these compositions, and those with weight percentages in between, have displayed the ability to achieve higher strengths by aging at approximately 450° C. to about 550° C. for from about 4 to about 25 hours. For example, following water quenching from 810° C. and aging for 4 hours at 530° C., the 40 weight percent tantalum alloy has a yield strength of 143,000 ksi (101 kg/mm$^2$). The elongation appropriately drops to about 4 percent.

Although the present invention has been described with reference to specific details, it is not intended that such details should be regarded as limitations upon the scope of the invention, except as and to the extent that they are included in the accompanying claims.

What is claimed is:

1. A process of preparing a titanium-tantalum alloy comprising;

forming a mixture of essentially pure titanium powder and essentially pure tantalum powder;

melting the mixture of titanium powder and tantalum powder by plasma torch melting under a pressure greater than atmospheric pressure to form a titanium-tantalum solution; and, casting the molten solution of titanium-tantalum to form a solid homogeneous titanium-tantalum product.

2. The process of claim 1 further including hot-rolling the cast solid homogeneous titanium-tantalum product to form a sheet of the titanium-tantalum product.

3. The process of claim 2 wherein the hot-rolling of the cast solid homogeneous titanium-tantalum product is conducted in air.

4. The process of claim 1 further including heat-treating the cast solid homogeneous titanium-tantalum product.

5. The process of claim 3 further including heat-treating the hot-rolled titanium-tantalum product.

6. The process of claim 1 wherein said melting is conducted under an inert atmosphere.

7. The process of claim 6 wherein said melting is conducted under an argon atmosphere of about 1.05 atmosphere.

* * * * *